US008544988B1

(12) United States Patent
Hooker et al.

(10) Patent No.: US 8,544,988 B1
(45) Date of Patent: Oct. 1, 2013

(54) RECYCLABLE AND REMANUFACTURABLE MICROPROCESSOR-BASED POSTAL EVIDENCING MODULE AND METHOD OF RECYCLING AND REMANUFACTURING

(75) Inventors: Randall Ellis Hooker, Redmond, WA (US); Eric Tuvesson, Newbury Park, CA (US)

(73) Assignee: Clover Technology Groups, LLC, Ottawa, IL (US)

( * ) Notice: Subject to any disclaimer, the term of this patent is extended or adjusted under 35 U.S.C. 154(b) by 0 days.

(21) Appl. No.: 13/604,520

(22) Filed: Sep. 5, 2012

(51) Int. Cl.
*B41J 2/14* (2006.01)

(52) U.S. Cl.
USPC ..... 347/49; 347/108

(58) Field of Classification Search
USPC ..... 347/49, 19, 87, 108
See application file for complete search history.

(56) References Cited

U.S. PATENT DOCUMENTS 6,234,626 B1 * 5/2001 Axtell et al. ..... 347/108
6,238,038 B1 * 5/2001 Gilham et al. ..... 347/49
6,378,978 B1 * 4/2002 Chang et al. ..... 347/19
6,409,326 B1 * 6/2002 Giles et al. ..... 347/87

* cited by examiner

*Primary Examiner* — Anh T. N. Vo
(74) *Attorney, Agent, or Firm* — Bauman, Dow & León, P.C.; Alberto A. León

(57) ABSTRACT

The present invention relates to postal evidencing modules that can be recycled in a non-destructive fashion for reuse and remanufacturing. The modules comprise a cartridge-receiving portion and a lid, which can be manually disengaged from one another by the user in order to assist in reuse and remanufacturing. The modules further comprise flex circuits with one or more microprocessors to electrically engage the ink cartridges and a postage evidencing system. The present invention is designed to use commercially available ink cartridges and microprocessors.

8 Claims, 8 Drawing Sheets

RECYCLABLE AND REMANUFACTURABLE MICROPROCESSOR-BASED POSTAL EVIDENCING MODULE AND METHOD OF RECYCLING AND REMANUFACTURING

STATEMENT REGARDING FEDERALLY SPONSORED RESEARCH AND DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

CROSS-REFERENCE TO RELATED APPLICATION

Not applicable.

BACKGROUND OF THE INVENTION

1. Field of the Invention

The invention relates generally to recyclable and remanufacturable goods, and more specifically to recyclable and remanufacturable microprocessor-based ink cartridges, employed as postal evidencing modules, and methods to recycle and remanufacture those components.

2. Description of the Related Art Including Information Disclosed Under 37 CFR 1.97

Historically, the popularity and frequency with which many recycling processes have been used has been a function of supply and demand, much like most commercial enterprises.

There are concrete accounts of recycling activities dating back to 400 BC.

Historically, the needs associated with wartime activities and economic need have brought about the development of many recycling technologies. For example, in almost every major war, armies melted metals from jewelry, coins and other sources to manufacture weapons and other war-useful products. Further, historical times of famine, epidemic and overwhelming natural disaster usually have translated into minimizing the amount of waste, which has ultimately led to new forms of recycling or refined existing modalities of re-using or recycling.

The advent of modern mass production initially reduced the incidence of recycling. The industrial revolution resulted in lower costs and higher volumes of manufactured goods. It was initially easier and cheaper to manufacture, use and throw away many products rather than attempting to recycle or remanufacture them. This was especially evident in the 1950s and 1960s. In the 1970s, recycling efforts resurged with the advent and increased popularity of recycling centers. The so-called "environmental movement" and the concomitant public awareness of the environmental damage being caused by many manufacturing industries spearheaded that resurgence. Another obvious advantage of recycling, which in part motivated its resurgence in the 1970s, is that recycling of certain materials consumes less energy and is often less costly than virgin extraction and production. Such advantages apply across the board to the manufacture of everyday consumption products such as those based on plastic, glass, paper and many metals.

Today, recycling of many goods has become a multi-billion dollar industry in the United States alone. The emphasis on reuse of natural resources is stimulated by the environmental impact of what has been historically regarded as refuse. Recycling has evolved to become a standard practice in our society in the past 40 years, as evidenced by the many jurisdictions in the U.S. that have passed laws requiring the collection of reusable materials down to the individual, household level.

Recycling has evolved from the collection of basic waste materials such as paper, glass and plastic, to include materials and devices that contain harmful materials such as mercury and lead, or valuable content such as copper and cadmium. Recycling technology has evolved from hand sorting to employing sophisticated and dedicated, patented machinery to enable the safe handling or efficient reclamation of materials, objects and devices.

The recycling process can be enhanced when an object or device is engineered at the original design level with consideration of the eventual recycling of that object or device. That consideration allows efficiencies specific to recycling or remanufacturing to be designed into the product in anticipation of the product's use and its subsequent recycling or remanufacturing.

In general, the process of recycling an object can occur in three ways:

1. Deconstruction of the object to sort recyclable materials from waste. That process may lead to the reprocessing of some materials, such as plastics, for use in the manufacturing of dissimilar objects or devices. The present application will refer to that process hereinafter as "Destructive Recycling."
2. Deconstruction of the object or device to reclaim, reuse or repurpose components and other parts of ongoing value. The present application will refer to that process hereinafter as "Component Salvaging."
3. Reconditioning of the entire object or device for reuse for the same originally intended purpose. That step may or may not require deconstruction. The present application will refer to that process hereinafter as "Remanufacturing."

The present invention is a postal evidencing module in which the structure, configuration of components and access to programming points considers its after-use recycling and remanufacturing. Postage meters are properly referred to as "postage evidencing systems." A postage evidencing system is a device or system of components used to print evidence that postage required for mailing has been paid. In the US, postage evidencing systems use specialized United States Postal Service-approved fluorescent ink to prevent fraud and enable automated verification of valid postage.

The prior art ink modules for postage evidencing systems do not contain ink modules in which the structural features are so arranged as to provide the functionality that the present invention achieves. Specifically, none of the prior art modules are designed to be recyclable and at the same time comprising a reprogrammable microprocessor. The prior art references are capable of achieving the contrary purposes when compared with the module of the present invention. In fact, the prior art modules are specifically designed to provide the degree of security necessary to prevent Component Salvaging and Remanufacturing.

U.S. Pat. No. 6,238,038 to Gilham, et al., discloses and claims the only microprocessor-based postal evidencing module of the prior art. The Gilham, et al., module, however, exemplifies the purpose of most modules in the sense that the device is designed to effectively inhibit both reuse of components and the remanufacture of the module. In short, the Gilham, et al., module represents the kind of device the module of the present invention is designed to replace.

The device disclosed by the Gilham, et al., U.S. patent achieves its purpose of preventing recycling and remanufacturing as follows:

1. The sealed module's housing must be cut open to determine the type and quantity of ink cartridges housed inside. This destructive process renders the module unfit for remanufacturing in an "as new" condition.
2. The microprocessor utilized in the module is proprietary and cannot be sourced as a replacement part; third parties cannot reprogram it or repurpose it for use in any other devices or applications.
3. The programming data applied to the microprocessor includes an "Install By" date. That feature of the Gilham, et al., module is mandated by the corresponding logic in the host machine with which the module communicates. If a user fails to employ the module before the "Install By" date, the module is irreversibly disabled and unusable. This results in conversion of the module to waste prior to any use, and a loss of investment to the user/purchaser.

U.S. Pat. No. 6,312,072 to Hough claims a module comprising a circuit capable of self-destructing at the end of the device's life. Like the Gilham, et al., module the Hough module is specifically designed to prevent recycling and remanufacturing.

Original Equipment Manufacturers ("OEMs") generally tend to design their products' components and assemblies with the goal of preventing third parties from repurposing or remanufacturing the products at the end of the products' life. Recently, some OEMs have become involved in destructive recycling efforts in order to conform to environmental pressure and expectations. Destructive recycling also serves the OEM by eliminating the original product entirely, thus denying third parties access to recoverable assemblies or components embodied in the products.

Significantly, some OEMs in fields unrelated to the present invention have sought and obtained patents for methods and processes to reuse end-of-life devices. That recent trend has resulted in standards for the patentability of devices and methods based on enhancing the recyclability and remanufacture of various products.

SUMMARY OF THE INVENTION

The present application discloses and claims a microprocessor-based postal evidencing module, the structural elements of which allow enhanced component salvaging and remanufacturing. To that end, it is an object of the present invention to provide a microprocessor-based postal evidencing module with an enclosure capable of being disassembled manually and by non-destructive means, thus allowing salvaging and remanufacturing of internal components.

It is a further object of the present invention to provide an enclosure that allows for visual identification of the type and quantity of standard ink cartridges contained in the module prior to deconstruction, thus enabling selection of components for salvaging or replacement without requiring disassembly.

It is another object of the present invention to allow the use of a commercially available microprocessor, and the structure of the housing allows the microprocessor to be accessed externally in order to reprogram it to an "as-new" state for remanufacturing purposes. The microprocessor used in the present invention can also be salvaged and repurposed for other uses.

DETAILED DESCRIPTION OF THE INVENTION

Figure 1:
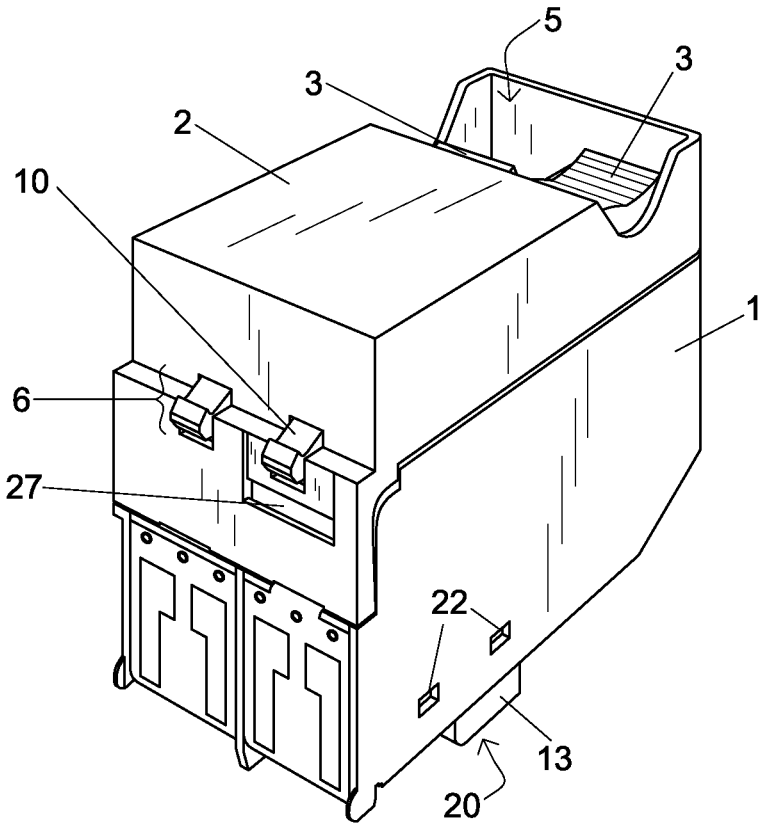
FIG. 1 is a front perspective drawing of the preferred embodiment of the invention without the ink outlet cover.

The invention disclosed and claimed in the present application comprises a housing capable of containing one or more standard ink cartridges (3) and the invention's internal electronic components. The housing comprises a cartridge receiver (1) and a lid (2). In the preferred embodiment, the lid (2) further comprises one or more openings (5), which expose a portion of the enclosed standard ink cartridge(s) (3). The opening(s) enables visual determination of the type and quantity of the internal standard ink cartridge(s). This feature allows determination of salvage content or the selection of replacement components in the remanufacturing process without further disassembly or destruction of the module. The housing further comprises an ink outlet cover (4), which seals the ink-emitting portion (20) of the ink cartridge(s) (3). The user removes the ink outlet cover (4) prior to insertion of the ink module into a postage evidencing system, exposing the ink-emitting surface (20) of the ink cartridge(s) (3).

The housing further comprises a latching mechanism, which allows the lid (2) and the cartridge receiving portion (1) of the housing to be removably connected to one another. While latched together, the housing components are engaged using tabs, slots and similar features, which allow for manual separation. The latching mechanism's configuration facilitates replacement of internal components in a non-destructive fashion, and allows for reconstruction of the module to its original condition once the depleted components have been replaced.

The latching mechanism allows the removable lid (2) to be affixed to the cartridge receiver (1) of the invention, forming non-permanent joints (6). The latching mechanism can comprise multiple variations of tabs, flaps, openings, slots, protrusions, protuberances, indentations, depressions, hooks, anchor points, hinges, recesses and similar features that allow the two elements to be joined together in a stable manner, while still being manually separable with exertion of pressure by the user in the proper direction. The non-permanent joints (6) or latching mechanism could be created through a number of alternative arrangements of elements. The sole function of the latching mechanism is to securely hold the lid in place until such time as the user wants to disengage the lid (2) from the cartridge receiver (1), so the exact arrangement of elements can vary. The exertion of pressure may require tools in some embodiments of the invention. When assembled, the housing has the same general shape, regardless of the combination of elements used to comprise the non-permanent joints. The joints (6) can be located on the front and back or on the sides of the cartridge receiver (1) and lid (2).

In the preferred embodiment, the latching mechanism is located on the front side and the backside of the housing. The front side of the cartridge receiver (1) comprises two anchor pins (10). The front side of the removable lid comprises two openings (9) through which the anchor pins (10) can be inserted to form a non-permanent joint (6). The backside of the cartridge receiver (1) comprises a linear protrusion (11). The backside of the removable lid (2) comprises a tab (7) that terminates in a slightly curved lip (14). The tab (7) comprises a linear slot (8) that lines up with the linear protrusion (11) on the cartridge receiver (1). The removable lid (2) is attached to the cartridge receiver (1) by aligning the openings (9) of the front side of lid with the anchor pins (10) on the front side of the cartridge receiver and inserting the anchor pins (10) through the openings (9). This procedure forms a hinge-like non-permanent joint (6). Once the non-permanent joint is formed at the front of the housing, the linear protrusion (11) on the front side of the cartridge receiver (1) and the linear slot (8) on the front side of the removable lid's tab (7) can be aligned. When the slot (8) is pressed over the protrusion (11), the removable lid (2) forms a firm connection to the cartridge receiver (1), resulting in the housing of the invention.

Figure 2:
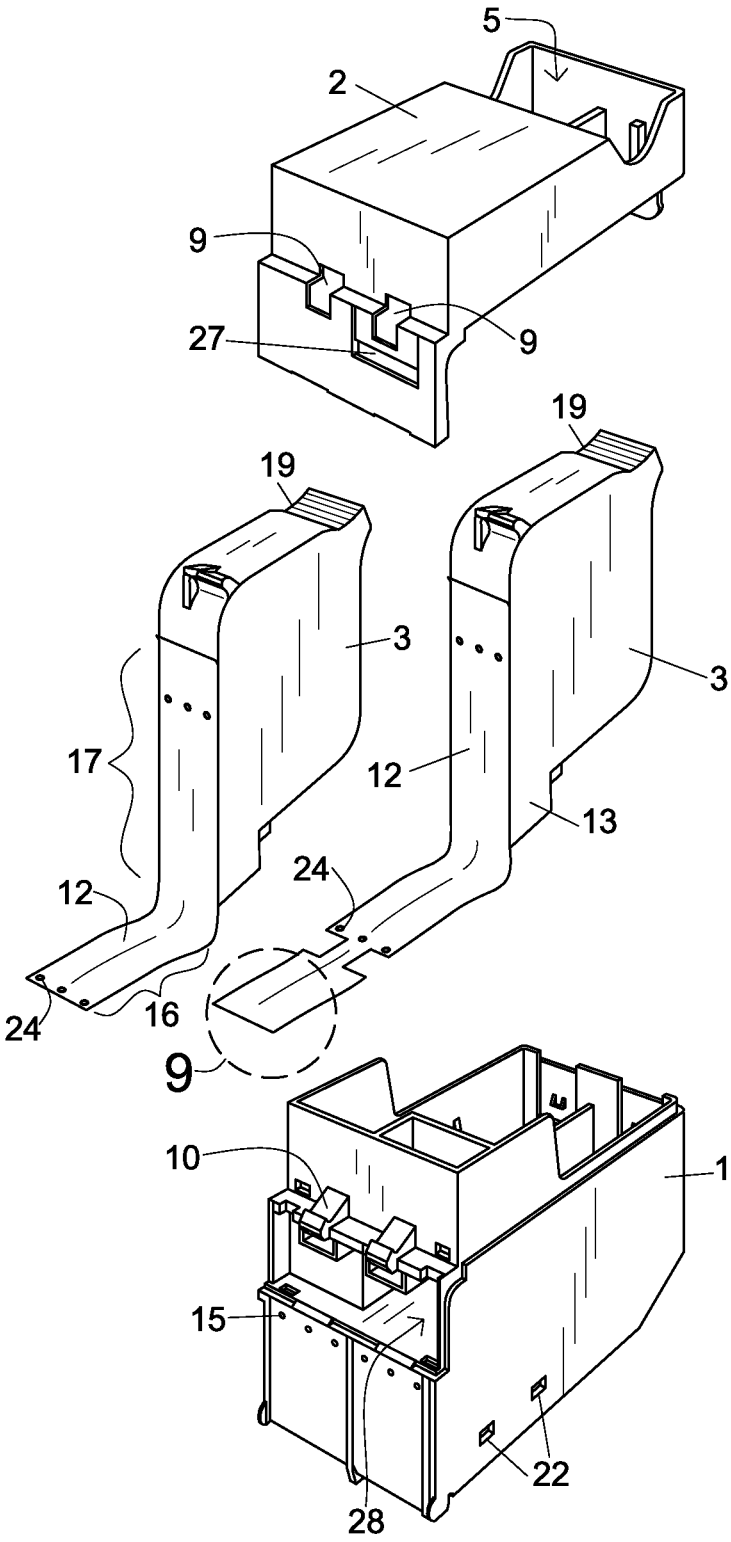
FIG. 2 is an exploded view of FIG. 1, showing the various components thereof.
Figure 3:
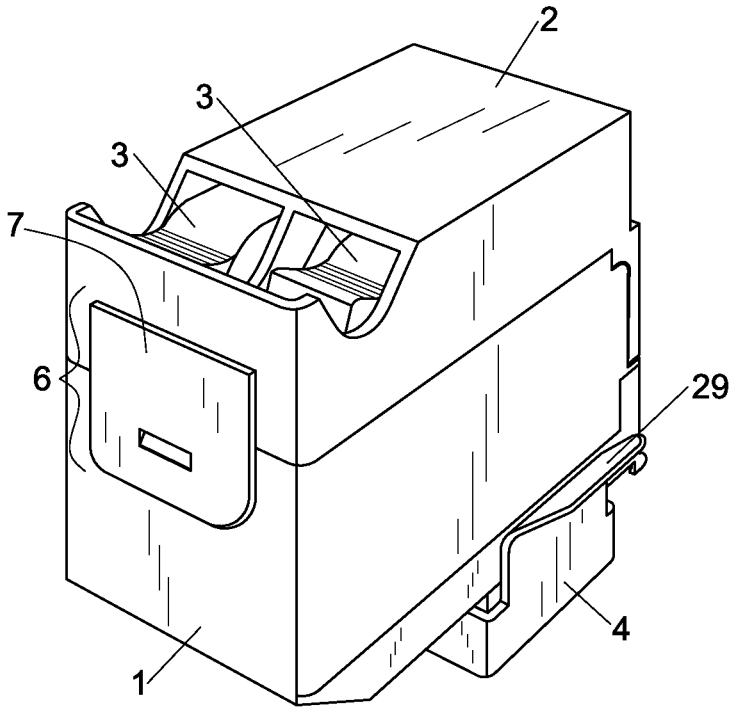
FIG. 3 is a rear perspective drawing of the preferred embodiment of the invention with the ink outlet cover attached to the cartridge-receiving portion of the housing.
Figure 9:
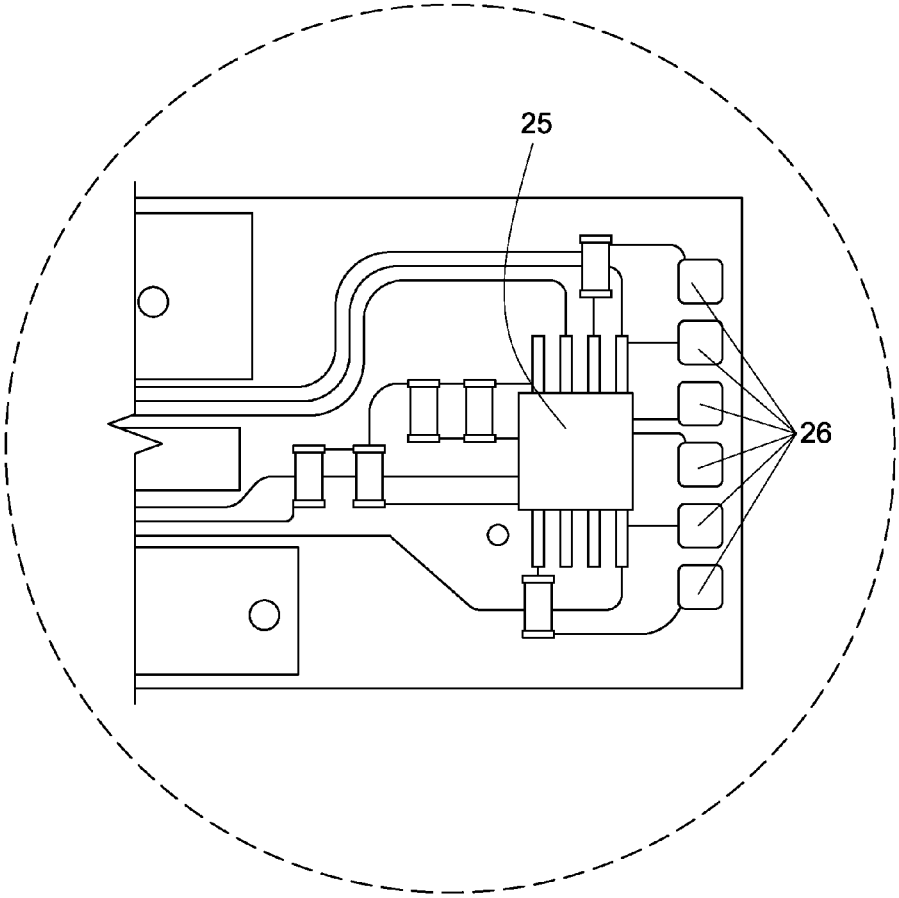
FIG. 9 is an enlarged top view of the preferred embodiment of the distal portion of the right flex circuit from FIG. 2.

The preferred embodiment of the invention comprises a commercially available microprocessor (25) capable of being replaced by third parties other than the OEM. The microprocessor (25) is engaged to a flex circuit (12). The microprocessor can be salvaged and repurposed in order to be used with alternative devices and/or applications. In the preferred embodiment, the microprocessor (25) is electrically engaged to programming points (26) that can be accessed from outside the housing without the need to disengage the lid (2) from the cartridge receiver (1). As illustrated in FIG. 9, the programming points (26) are integrated in the flex circuit (12) adjacent to the microprocessor (25). In the preferred embodiment of the invention, the microprocessor and programming points are located on the distal end (16) of a long flex circuit, as illustrated on the right in FIG. 2. When the module is fully assembled, the distal end and its microprocessor are affixed to a recess (28) in the front of the cartridge receiving portion (1) of the housing. In the preferred embodiment, the front of the lid further comprises an access slot (27) which is situated below the right opening (9) for the non-permanent joint, as shown in FIGS. 1 and 2. When the housing is assembled, the access slot (27) on the lid (2) opens into the recess (28) in the cartridge receiving portion (1). A user can access the programming points (16) through the access slot (27) with the use of appropriate tools. This accessibility allows the module of the present invention to be reprogrammed for purposes of remanufacturing, reconfiguring for use in multiple host meter models, or reprogrammed with an updated "Install By" date to address user error in that regard. Such reprogramming can be accomplished without the need for deconstruction of the module.

Each flex circuit (12) extends from the outside of the housing to the inside. The flex circuit (12) makes an electrical connection between an ink cartridge (3) inside the housing and the postage evidencing system upon installation of the ink module onto a postage evidencing system. The portion of the flex circuits that is on the outside of the housing is capable of making an electrical connection with the postage evidencing system.

In the preferred embodiment of the invention, the module is capable of holding two standard ink cartridges (3) in an offset fashion. However, for some postage evidencing systems, a different number of ink cartridges may be required. In addition, the ink cartridges may be side-by-side instead of offset in some embodiments.

In the preferred embodiment of the invention, two flex circuits (12) are affixed to the front of the cartridge receiver (1). The distal portion (16) of each flex circuit (12) is removably affixed with heat-sensitive bonding tape onto the cartridge receiving portion (1). The flex circuits can be permanently affixed onto the cartridge receiving portion or alternative bonding means can also be employed to affix the flex circuits (12) to the cartridge receiver (1). In the preferred embodiment, the cartridge receiving portion comprises locating pins (15), which correspond to holes (24) in the flex circuits (12). The locating pins (15) and corresponding holes (24) assist in assembly of the flex circuits (12) onto the cartridge receiver (1). The proximal portion (17) of each flex circuit (12) is affixed to the ink cartridge (3).

The flex circuits may comprise one or more microprocessors (25) and programming points (26). In the preferred embodiment, the distal portion (16) of the right flex circuit comprises a microprocessor and programming points. This distal portion is affixed to the recess (28) in right front of the cartridge receiver (1). As illustrated in FIG. 1, the right flex circuit extends from the recess, through the seam between the lid and cartridge receiver, to the outside of the housing, where its holes (24) can be engaged to the locating pins (15). The left flex circuit's distal portion (16) engages the locating pins (15). Both flex circuits extend from the locating pins (15) on the cartridge receiving portion's front into the openings (18) in the cartridge-receiving portion's bottom. When fully assembled, the flex circuits (12) enter the cartridge receiving portion's openings (18) adjacent to the protrusion (13) of the ink cartridge (3). The locating pins (15) are positioned in such a way that they will hold the flex circuit(s) (12) in a proper position to make an electrical connection with a postage evidencing system when installed.

Figure 4:
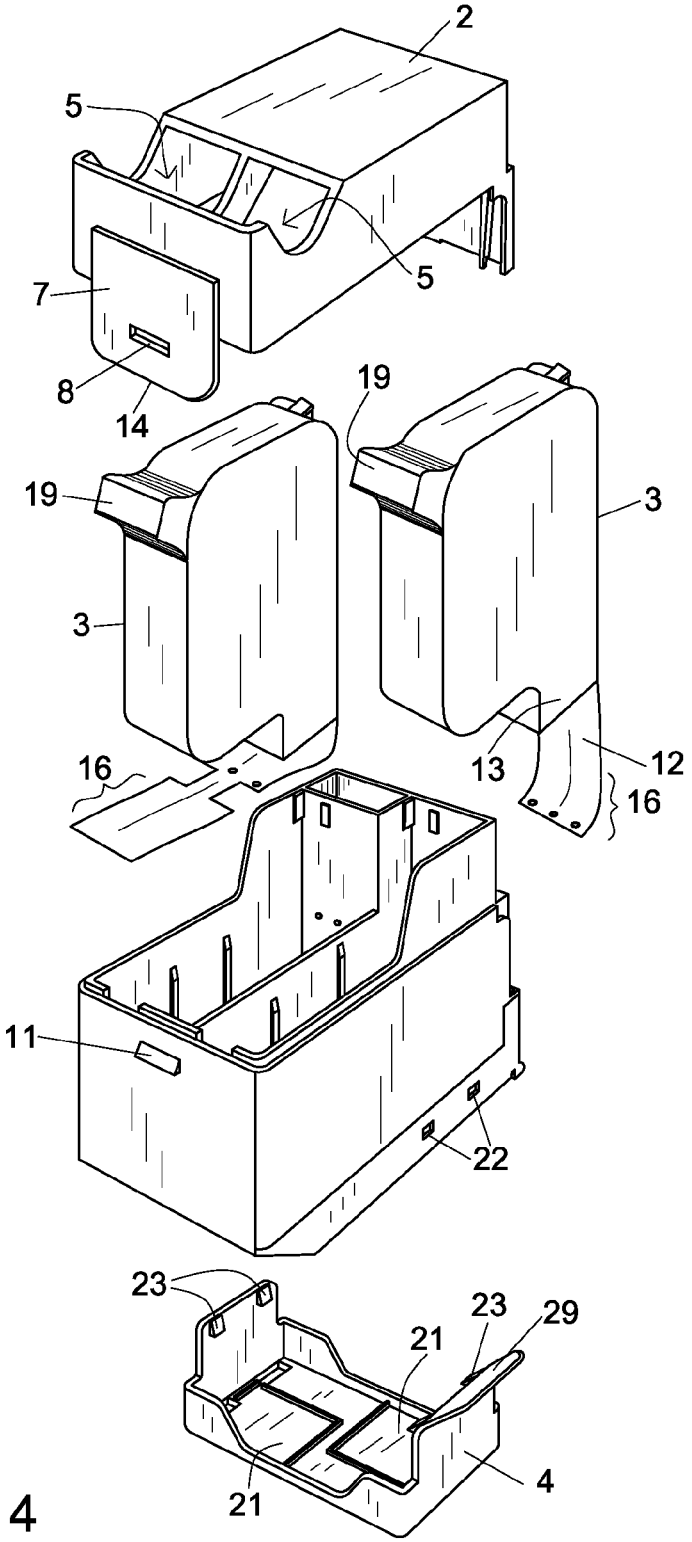
FIG. 4 is an exploded view of FIG. 3, showing the various components thereof.
Figure 5:
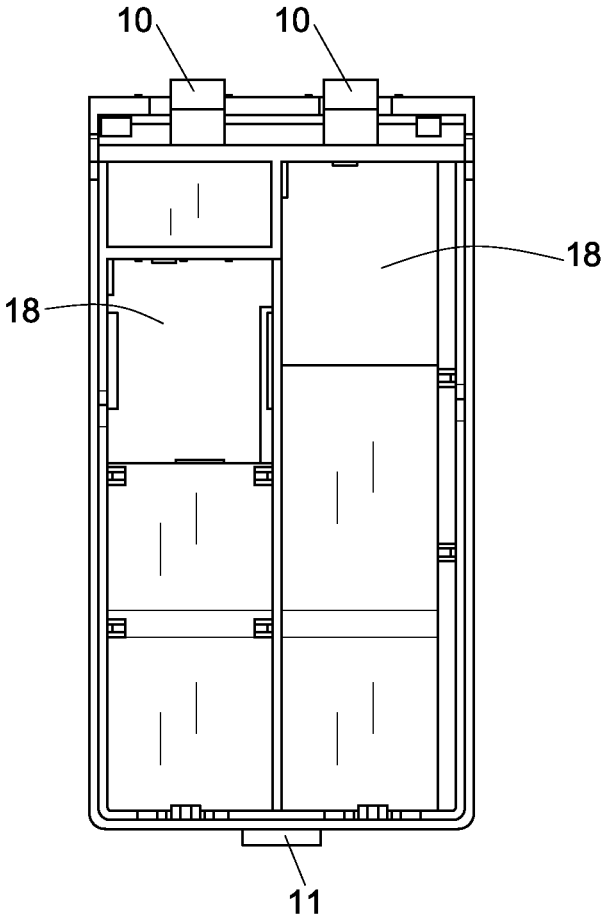
FIG. 5 is a top view of the preferred embodiment of the cartridge-receiving portion of the invention.
Figure 6:
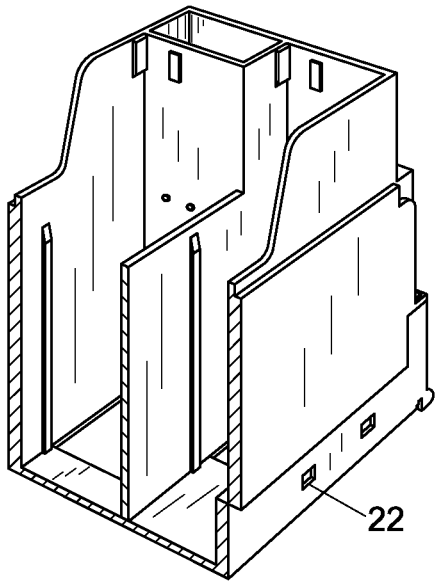
FIG. 6 is a perspective sectional view of the front half of the preferred embodiment of the cartridge-receiving portion of the invention.
Figure 7:
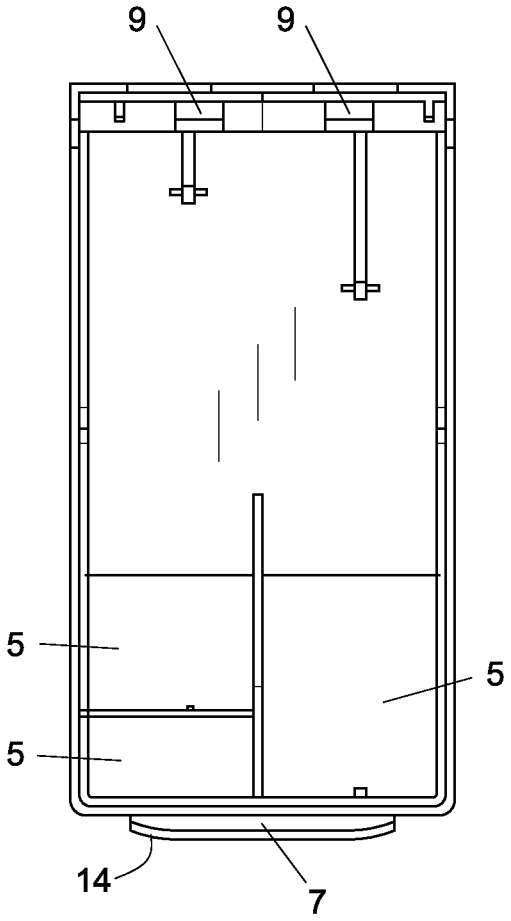
FIG. 7 is a bottom view of the preferred embodiment of the removable lid of the invention
Figure 8:
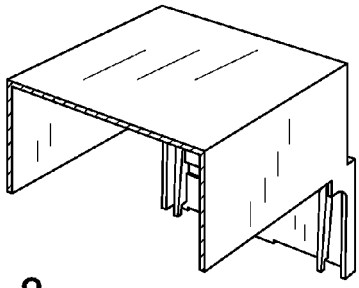
FIG. 8 is a perspective sectional view of the front half of the preferred embodiment of the removable lid of the invention.

As illustrated in FIGS. 2 and 4, one or more standard ink cartridges (3) can be housed inside the cartridge receiver (1). A standard ink cartridge (3) comprises an ink-emitting surface (20), which is at the distal end of a protrusion (13) on the bottom of the cartridge. Standard ink cartridges usually also comprise a curved "handle" (19) at the top rear of the cartridge, which allows the cartridge to be easily manipulated and placed into the cartridge receiver (1). The protrusion (13) with the ink-emitting surface (20) of the cartridge corresponds to the opening(s) (18) in the bottom of the cartridge receiver (1). However, the opening(s) (18) is of sufficient size to expose both the ink emitting surface (20) and an adjacent portion of the cartridge. The cartridge's "handle" (19) corresponds to the opening (5) in the top of the lid. The ink cartridge (3) further comprises a series of electrical contacts. When the ink cartridge (3) is properly seated within the cartridge receiver (1) and the flex circuit is properly affixed to the ink cartridge and the housing, an electrical connection is created. The result is an electrical connection between the ink cartridge (3) and the postage evidencing system when the evidencing module is installed in the postage evidencing system. The cartridge receiver (1) is shaped in such a way that each ink cartridge (3) is securely supported in the proper position to engage the postage evidencing system. FIGS. 2 and 4 through 8 show multiple molded protrusions on the interior surfaces of the cartridge receiving portion and the lid that secure the ink cartridge inside the housing.

The prior art includes ink modules in which ink cartridges are directly next to each other and others where the ink cartridges (3) are offset from one another. In the preferred embodiment, the ink cartridges, and therefore their inking surfaces (20), are offset.

In the preferred embodiment, the removable lid (2) comprises one or more openings (5) positioned to correspond to the position of labeling information on one or more ink cartridges (3) within the housing. The openings (5) allow a user to ascertain the type of ink cartridge within the housing without taking the housing apart.

The ink outlet cover (4) can be snapped into place on the cartridge receiving portion (1) to cover the ink emitting surfaces (20) of the ink cartridge (3). As illustrated in FIG. 4, the ink outlet cover (4) preferably comprises pads (21) that correspond to each ink-emitting surface (20) on the cartridge (3). The cover's (4) ability to engage the cartridge-receiving portion (1) is preferably achieved by corresponding recesses (22) and protrusions (23) in the shape of the cover and the housing. However, alternative means of engaging the cover (4) to the housing can be employed. In the preferred embodiment, the ink outlet cover (4) comprises a tab (29) that angles away from the housing. This tab (29) assists in removal of the cover prior to installation in a postage evidencing system.

The method of recycling and remanufacturing of the present invention begins with removing the removable lid from the cartridge-receiving portion, which exposes the cartridge(s) inside. In the preferred embodiment, the back of housing or cartridge receiving portion has one or more protuberances that correspond to one or more slots on the back of the lid. A user can apply pressure to the curved lip of the tab on the backside of the lid to pull the linear slot(s) off of the linear protuberance(s) to unlatch the back portion of the lid from the cartridge receiver. The front of the cartridge receiver has anchor pins that correspond to openings on the front of the lid. Once the lid and the receiving portion are disengaged, the back side of the lid can be cantilevered upward and forward to move the openings off of the anchor pins at the front side of the lid, resulting in disengagement of the lid from the cartridge receiver. Next, the user applies heat to the flex circuits to release the bonding means. Once sufficient heat has been applied to the bonding means, the flex circuits can be separated from the cartridge receiver. After the flex circuits are freed, the ink cartridges can be removed from the cartridge receiver. The openings in the bottom side of the cartridge allow access to the ink-emitting surfaces of the cartridge, as well as an adjacent non-ink emitting surface. In order to dislodge the cartridge from the cartridge receiver, the user applies pressure to this exposed cartridge surface. The pressure frees the cartridge from the housing, allowing it to be removed. The handle near the top of each cartridge facilitates removal once the cartridge has been dislodged. Once the cartridges have been removed from the cartridge receiver, the cartridges can be replaced or other remanufacture of the module can take place. Reassembly and replacement of the cartridge(s) in the housing is achieved by reversal of the method of recycling and remanufacturing of the present invention.

We claim:

1. A recyclable and remanufacturable postal evidencing module comprising:

a. a housing, the housing further comprising a cartridge receiving portion, a removable lid, a removable ink outlet cover and one or more flex circuits;

b. the cartridge receiving portion and the removable lid both comprising attachment means receiving multiple attachable, corresponding and complementary elements on the cartridge receiving portion and the removable lid that are interacting to result in the removable lid being fastened to the receiving portion;

c. the cartridge receiving portion comprising an open top side and a bottom side, the bottom side of the cartridge receiving portion comprising one or more openings;

d. the removable ink outlet cover covering the openings in the bottom side of the cartridge receiving portion;

e. the flex circuits comprising one or more microprocessors, the flex circuits being capable of engaging the cartridge receiving portion and engaging an ink cartridge, and electrically connecting one or more ink cartridges with a postage evidencing system, the flex circuits being affixed to the cartridge receiving portion; and f. the housing securely engaging and containing one or more postal ink cartridges.

2. The recyclable and remanufacturable postal evidencing module according to claim 1, wherein the attachment means are selected from the group consisting of tabs, flaps, openings, slots, protrusions, protuberances, indentations, depressions, hooks, anchor points and hinges.

3. The recyclable and remanufacturable postal evidencing module according to claim 1, wherein the removable lid comprises one or more openings positioned to correspond to the placement of identifying features on an ink cartridge.

4. The recyclable and remanufacturable postal evidencing module according to claim 1, wherein the flex circuits are removably affixed to the cartridge receiving portion with a bonding means, and the bonding means comprises heat sensitive bonding tape.

5. The recyclable and remanufacturable postal evidencing module according to claim 1, wherein the flex circuit comprises programming points located on the flex circuit, the programming points reprogramming the microprocessor and wherein the removable lid comprises an opening that allows a user to access the programming points without removing the lid.

6. The recyclable and remanufacturable postal evidencing module according to claim 1, wherein the cartridge receiving portion further comprises multiple locating pins, the locating pins receiving the flex circuits.

7. A recyclable and remanufacturable postal evidencing module comprising:

a. a housing, the housing further comprising a cartridge receiving portion, a removable lid, a removable ink outlet cover and one or more flex circuits;

b. the cartridge receiving portion comprising a front side, a back side, two lateral sides, a bottom side and an open top side;

c. the back side of the cartridge receiving portion comprising one or more protuberances;

d. the front side of the cartridge receiving portion comprising multiple anchor pins and multiple locating pins;

e. the bottom side of the cartridge receiving portion comprising one or more openings, f. the removable ink outlet cover being capable of covering the openings and engaging the lateral sides of the cartridge receiving portion;

g. the removable lid comprising a front side, a back side, a top side and an open bottom side;

h. the top side of the removable lid comprising one of more openings adjacent to the front side in a position that corresponds to identifying features on an ink cartridge within the housing;

i. the back side of the removable lid comprising a tab, the tab comprising one or more slots engaging the cartridge receiving portion's protuberances;

j. the front side of the removable lid comprising multiple openings engaging the anchor pins on the front side of the cartridge receiving portion;

k. the flex circuits comprising a proximal end, a distal end, a microprocessor and multiple programming points at a flex circuit's distal end, the flex circuits engaging the locating pins on the front side of the cartridge receiving portion and electrically connecting one or more ink cartridges with a postage evidencing system, the flex circuits extending from the locating pins on the front side of the cartridge receiving portion into the openings in the bottom side of the cartridge receiving portion and onto the ink cartridge, the flex circuits being removably affixed to the cartridge receiving portion with heat-sensitive bonding tape, the programming points being capable of reprogramming the microprocessor, the programming points being accessible through an opening in the removable lid;

l. the housing securely engaging and enveloping one or more postal ink cartridges; and m. the postal ink cartridges comprising an inking surface, the housing firmly engaging the postal ink cartridge in such a way that the inking surface protrudes through the opening in the bottom side of the cartridge receiving portion.

8. The method of recycling and remanufacturing a postal evidencing module, the module comprising a cartridge receiving portion, a removable lid, one or more ink cartridges, a removable ink outlet cover and one or more flex circuits, comprising the steps of:

a. lifting a tab at a back side of the removable lid until a slot on the lid is free from a protuberance on a back side of the cartridge receiving portion;

b. disconnecting the lid from anchor pins on a front side of the cartridge receiving portion by cantilevering the back side of the lid upward and forward, resulting in openings in the lid separating from the anchor pins;

c. applying heat to the flex circuits to release heat-sensitive bonding tape, resulting in the separation of the flex circuits from the cartridge receiving portion;

d. applying pressure to an exposed portion of the ink cartridge through an opening in a bottom side of the cartridge receiving portion to press the cartridge upward, resulting in the removal of the cartridge(s) from the cartridge receiving portion;

e. affixing a proximal portion of a flex circuit to a different ink cartridge;

f. partially inserting the ink cartridge into the cartridge receiving portion, leading with the flex circuit;

g. threading a distal portion of the flex circuit through the opening in the bottom of the cartridge receiving portion;

h. applying pressure to the ink cartridge to fully engage the cartridge to the cartridge receiving portion;

i. affixing the flex circuit onto the cartridge receiving portion using heat-sensitive bonding tape in a position where the flex circuit is aligned with locating pins on the cartridge receiving portion;

j. engaging the removable ink outlet cover to the cartridge receiving portion;

k. aligning the openings on the front of the lid with the cartridge receiving portion's anchor pins;

l. grasping the lid's tab and pulling the lid into a closed position, wherein the slot in the tab engages the protuberance in the front of the cartridge-receiving portion.

* * * * *